US007520252B2

(12) United States Patent
Toulouse et al.

(10) Patent No.: US 7,520,252 B2
(45) Date of Patent: Apr. 21, 2009

(54) METHODS FOR ADJUSTING THE POWER OF A GAS-OPERATED APPARATUS

(75) Inventors: Bruno Toulouse, Valence (FR); Patrick Herelier, Saint-Jean-de-Muzols (FR)

(73) Assignee: Societe de Prospection et d'Inventions Techniques SPIT, Bourg les Valence (FR)

( * ) Notice: Subject to any disclaimer, the term of this patent is extended or adjusted under 35 U.S.C. 154(b) by 182 days.

(21) Appl. No.: 10/549,122

(22) PCT Filed: Mar. 19, 2004

(86) PCT No.: PCT/IB2004/001356

§ 371 (c)(1),
(2), (4) Date: Jun. 23, 2006

(87) PCT Pub. No.: WO2004/083725

PCT Pub. Date: Sep. 30, 2004

(65) Prior Publication Data

US 2006/0260310 A1 Nov. 23, 2006

(30) Foreign Application Priority Data

Mar. 19, 2003 (FR) ..... 03 03369

(51) Int. Cl.
*F02B 71/04* (2006.01)

(52) U.S. Cl. ..... 123/46 H; 123/46 A

(58) Field of Classification Search ..... 123/46 R, 123/46 A, 46 B, 46 H
See application file for complete search history.

(56) References Cited

U.S. PATENT DOCUMENTS

| | | | | |
|---|---|---|---|---|
| 3,746,235 | A | 7/1973 | Crabtree | |
| 4,365,471 | A | 12/1982 | Adams | |
| 4,773,581 | A | 9/1988 | Kawakami et al. | |
| 6,460,507 | B2 * | 10/2002 | Thieleke et al. | 123/260 |
| 6,491,015 | B1 * | 12/2002 | Thieleke et al. | 123/260 |
| 6,526,926 | B1 | 3/2003 | Towfighi | |
| 6,532,917 | B2 * | 3/2003 | Thieleke et al. | 123/46 SC |
| 6,779,493 | B2 * | 8/2004 | Doherty et al. | 123/24 A |
| 6,863,045 | B2 * | 3/2005 | Ricordi | 123/262 |
| 6,912,988 | B2 * | 7/2005 | Adams | 123/256 |
| 6,968,811 | B2 * | 11/2005 | Rosenbaum | 123/41.2 |
| 2002/0144498 | A1 * | 10/2002 | Adams | 60/39.6 |
| 2003/0230255 | A1 * | 12/2003 | Doherty et al. | 123/46 R |

FOREIGN PATENT DOCUMENTS

| | | |
|---|---|---|
| EP | 0 711 634 A2 | 5/1996 |
| EP | 0 788 863 A1 | 8/1997 |
| EP | 1 243 382 A2 | 9/2002 |

* cited by examiner

*Primary Examiner*—Hai H Huynh
(74) *Attorney, Agent, or Firm*—Lowe, Hauptman, Ham & Berner, LLP

(57) ABSTRACT

According to the invention, which applies to a gas-operated apparatus comprising a first chamber for the precompression of a combustible gas injected thereinto and generation of a flame, and a second, propulsion, chamber, and placing elements, the two chambers in communication, these elements being designed to allow the flame to pass, the power of the apparatus is adjusted by adjusting the communication between the two chambers. The volume of gas injected directly into the propulsion chamber can also be adjusted. Alternatively, the rotational speed of the fan with which the first chamber is equipped can be adjusted.

8 Claims, 1 Drawing Sheet

METHODS FOR ADJUSTING THE POWER OF A GAS-OPERATED APPARATUS

BACKGROUND

The invention relates to the adjustment of the power of gas-operated apparatuses comprising a first chamber of a first volume containing means for igniting and generating a flame in a combustible gas, a second chamber of a second volume, and means for placing the two chambers in communication, these means being designed to allow the flame to pass.

The invention relates more particularly to the adjustment of the power of internal combustion gas-operated sealing apparatus in which a piston is propelled under the action of the exploding of a mixture of gas and air in order, via its rod, to strike a nail; this is then a gas-operated nail gun, or some other fastening device.

Apparatuses with two chambers have advantages. With two chambers, the first is a precompression chamber which allows the explosion pressure in the second chamber to be increased, the explosion pressure in a volume being proportional to the pressure of the mixture before the explosion. What happens is that, because of the explosion in the first chamber, the combustion pressure thus generated in this first chamber compresses the unburnt mixture which is pushed by the flame front and passes into the second chamber to increase the pressure therein before the explosion occurs in this second chamber. If this second chamber is partially delimited by a drive piston, then by virtue of this precompression, the piston has moved only very slightly forwards at the time when the explosion occurs in this second chamber for propelling the piston, this allowing the piston to derive correct benefit from the energy of combustion of the gas.

When, in addition, there is a fan in the flame-generating chamber, the rate of combustion and the maximum pressure level in this chamber are increased, making it possible to reduce the rise time of this pressure and therefore to further limit the movement of the piston in its drive chamber before the explosion takes place, and therefore making it possible to further increase the power of the apparatus.

It will be noted that the effect of an accelerating fan is more than significant; it allows the pressure rise time to be reduced by a factor of the order of 10.

Being thus in possession of powerful apparatus, the applicant company realized that it could prove beneficial for an operator to have available to him, in one and the same apparatus, a given maximum power which is able however to operate at various power levels below that of maximum power, and this is what the applicant proposes in its invention.

SUMMARY

The invention relates first of all to a method for adjusting the power of a gas-operated apparatus comprising:

- a first chamber for the precompression of a combustible gas and generation of a flame,
- a second, propulsion, chamber, and
- means for placing the two chambers in communication, these means being designed to allow the flame to pass, characterized in that the power of the apparatus is adjusted by adjusting the communication between the chambers.

Adjustment can be carried out easily by operating at least one valve connecting the two chambers.

Thus, the less mixture is passed into the propulsion chamber, the more the pressure will be dropped and therefore the more the power of the apparatus will be reduced.

In the most common case, combustible gas is injected only into the first, flame-generating, chamber via which it is therefore not possible to adjust the power.

However, when the combustible gas is injected directly into the two chambers, as taught, for example, in U.S. Pat. No. 4,365,471, it is perfectly possible to adjust the power of the apparatus by adjusting the volume of gas injected into the second, propulsion, chamber.

Naturally, the power can be adjusted using both modes of adjustment, both adjusting the communication and adjusting the injection.

When the first, flame-generating, chamber is equipped with a fan, it is also possible to adjust the power by varying the rotational speed of the fan.

The invention also relates to a method for adjusting the power of a gas-operated apparatus comprising

- a first chamber for the precompression of a combustible gas injected thereinto and generation of a flame,
- a second, propulsion, chamber,
- an intermediate third chamber for the compression and acceleration of the flame, connecting the first and second chambers, and
- means for placing the chambers in communication in pairs, these means being designed to allow the flame to pass, characterized in that the power of the apparatus is adjusted by adjusting the communication between the chambers.

As a preference, the intermediate third chamber for the compression and acceleration of the flame is a tubular chamber with a cross section roughly equal to that of the flame generated in the first, flame-generating, chamber.

Advantageously, an accelerating fan is provided in the first, flame-generating, chamber.

In general, the apparatus of the method of the invention will be a sealing apparatus, the second, propulsion, chamber being delimited in particular by a piston for driving a fastener and intended to be propelled under the action of the exploding of the mixture in this second, propulsion, chamber.

As in the case of a two-chamber apparatus, it is perfectly possible in a three-chamber apparatus to adjust the power separately or in combination by

- adjusting the volume of gas injected into the propulsion chamber,
- double adjustment of both communication and injection,
- adjusting the rotational speed of the fan when the first, flame-generating, chamber is equipped with one.

As the useful volume lies essentially in the intermediate chamber, the volume of the first, flame-generating, chamber can be reduced, this affording the additional advantage of greatly facilitating the conditions under which the burnt mixture escapes and also the cooling of the apparatus.

It may even be desirable to establish conditions at the limits of the convergence of the first chamber and intermediate chamber, and so the applicant company also intends to claim a method for adjusting the power of a gas-operated apparatus comprising

- a first chamber for the precompression of a combustible gas and generation of a flame,
- a second, propulsion, chamber, and
- means for placing the two chambers in communication, these means being designed to allow the flame to pass,
- the first chamber being designed to be a chamber for precompression, generation of a flame and for the compression and acceleration of the flame, characterized in that the power of the apparatus is adjusted by
- adjusting the volume of gas injected into the propulsion chamber, or adjusting the communication between the two chambers, or dual adjustment of the communication and of the injection, or adjusting the rotational speed of a fan with which the first, flame-generating, chamber is equipped.

BRIEF DESCRIPTION OF THE DRAWINGS

The invention will be better understood with the aid of the following description of various embodiments of the method of the invention and of various embodiments of the apparatus the power of which is to be adjusted, with reference to the attached drawing in which.

DETAILED DESCRIPTION

Figure 1:
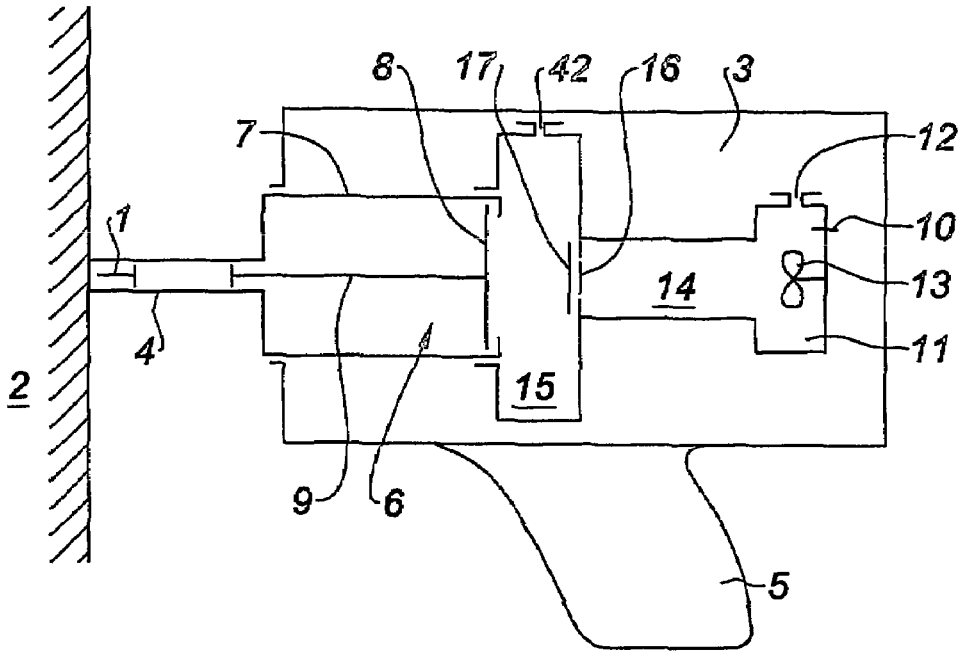
FIG. 1 is a schematic depiction of a three-chamber sealing apparatus.

The apparatus of FIG. 1 is a gas-operated nail gun for driving nails 1 into a material 2. It comprises a body 3 with, at the front, a tip guide 4 and, at the bottom, a handling and operating handle 5. To drive the nails 1, a piston 6, via its head 8, is mounted to slide in a cylinder 7. The piston 6 has a rod 9 for pushing the nails 1. The body 3 comprises a housing for accommodating a cartridge of a combustible gas intended to be injected into a set of combustion chambers before the gas and air mixture is ignited to propel the piston 6. The body 3 also comprises a cylinder head bearing an igniter plug 10 for igniting the mixture.

Here, in the body 3, there is a first chamber 11, with a gas inlet orifice 12 into which the igniter plug 10 protrudes, which chamber is a chamber for the precompression of the gas-air mixture and for generating a flame. The fan 13 of a motor-fan unit is mounted in this first chamber 11. The chamber 11 communicates with the entrance to a tubular intermediate chamber 14 which is a chamber for compression and acceleration of the flame. The tubular intermediate chamber 14 communicates, via its outlet and via a number of orifices 16 that can be closed off by a valve 17, with a last chamber 15, delimited in part by the piston head 8, which is a propulsion chamber which also has a gas inlet orifice 42.

The way in which the apparatus works will now be explained.

After the last, propulsion, chamber 15 has been closed and gas has been injected into the first chamber 11 and the propulsion chamber 15 via the respective orifices 12 and 42, the plug 10 will create a spark which will ignite the mixture of gas and air in the chamber 11, the burning of which mixture will cause the pressure in this chamber to rise. Because of the increase in pressure, the unburnt mixture from the first chamber 11 and especially from the intermediate tubular chamber 14 will, via the orifices 16, pass into the last, propulsion, chamber 15 and thus compress the mixture therein. The combustion flame, generated in the first chamber 11, on arrival in the tubular chamber 14, will be accelerated (almost exponentially) by virtue of the rise in pressure downstream, in the propulsion chamber 15. Passing through the same orifices 16, the flame will ignite the mixture in the last chamber 15, here then according to a "multipoint" ignition strategy.

The pressure in this last chamber will rise to a level above that of the two upstream chambers 14 and 11, and in a shorter space of time. The orifices 16 for communication between the last two chambers 14, 15 generate sonic flows, that is to say that the speed of the mixture and of the flame becomes higher than the speed of sound, by virtue of which the rate of combustion in the last, propulsion, chamber 15 will be very high. This being the case, there is practically no longer any need to hold the piston 6 still to prevent it from moving right at the start of the pressure rise. The rate of combustion is such that the maximum pressure is reached before the piston 6 has had time to move. In this particular instance, this lost movement is reduced to just a few millimeters.

It will be noted that the "multipoint" communication between chambers, in this instance the chambers 14 and 15, encourages the agitation of the mixture in the propulsion chamber 15 before the flame arrives.

The valve or valves blocking off the communication orifices may be used as pressure limiters and open only at a predetermined pressure so as to encourage sonic flow and increase the rate of combustion in the propulsion chamber 15.

It is also possible to envisage mechanical or electrical precompression in the first chamber, within the limit to which the valves open, in order to further increase the pressure level in the first chamber 11 and thus also in the propulsion chamber 15. The flame-generating 11 and propulsion 15 chambers may have a very small volume, making it possible to use less gas and thus improve the efficiency of the apparatus.

The first, flame-generating, chamber may be coincident with the chamber for the compression and acceleration of the flame, so as to further reduce the pressure rise time in the propulsion chamber.

Figure 2:
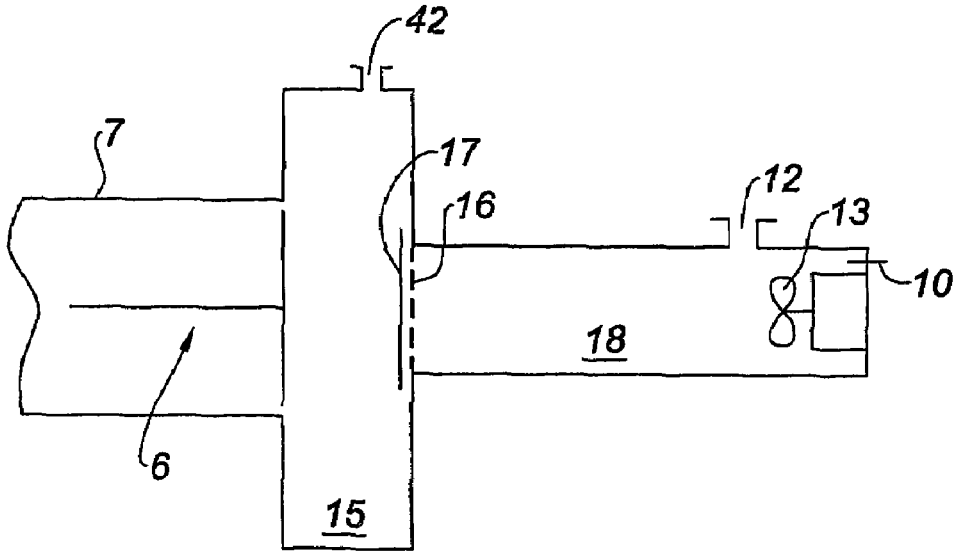
FIG. 2 is a schematic depiction of a two-chamber apparatus.

With reference to FIG. 2, in which elements analogous to those of FIG. 1 are referenced with the same numbers, the apparatus has just two chambers: the final, propulsion, chamber 15, delimited downstream, on the same side as the cylinder 7, by the piston 6, and a first chamber 18, with multiple functions of precompression, generating the flame, compression and acceleration of the flame, with the fan 13 and the igniter plug 10, this first chamber 18 being tubular and communicating with the propulsion chamber 15 via a plurality of orifices 16 and one or more valves 17, the two chambers having their respective gas inlet orifices 12 and 42. For the remainder, the way in which the embodiment of FIG. 2 of the apparatus of the invention works is similar to the operation of the embodiment of FIG. 1.

In both cases, the precompression and final compression pressure level in the final last propulsion chamber 15 depends on the length and volume of the tubular chamber 14, 18. The tube may be coiled on itself to reduce the space occupied.

The method of the invention also applies to a conventional apparatus provided with just two chambers, the first being for precompression and generation of a flame, the second being for propulsion.

There is no need to depict in the drawing such an apparatus which is identical to the apparatus of FIG. 1 except that it would have no intermediate chamber for compression and acceleration of the flame.

The power of all these apparatuses can be adjusted by three different means that can be used separately or in combination. The first means consists of adjusting the communication between the chambers, via the orifices 16, by in particular adjusting the setting at which the valves 17 open.

The second means consists in adjusting the metering of the direct injection of gas into the final, propulsion, chamber 15 through the orifice 42.

The third means consists of adjusting the speed of the fan 13.

It will be noted that the volume of gas in the final, propulsion, chamber is also metered by the setting at which the valves 17 open.

The invention claimed is:

1. Method for adjusting the power of a gas-operated apparatus, said method comprising:

injecting a combustible gas mixture into a first chamber, said first chamber adjustably communicable with a second chamber;

precompressing the combustible gas mixture in the first chamber when the first chamber is isolated from the second chamber and then generating a flame in the first chamber to combust the gas mixture;

allowing the flame to pass from the first chamber to the second chamber;

a combustion pressure generated in the first chamber compresses an unburnt portion of the gas mixture which is pushed by the flame from the first chamber into the second chamber to increase a pressure in the second chamber; and the power of the apparatus is adjusted by adjusting the communication between the first and second chambers.

2. The method according to claim 1, in which the communication is adjusted by operating at least one valve adapted to close and open an orifice connecting the first and second chambers.

3. The method as claimed in claim 1, further comprising:

before allowing the flame to pass through the first chamber to the second chamber, passing the flame generated in the first chamber through an intermediate chamber for accelerating and further compressing the flame, said intermediate chamber connecting a plurality of orifices and the first chamber, thereby placing the first chamber in communication with the second chamber.

4. The method according to claim 3 in which the communication is adjusted by operating a valve adapted to close and open the respective orifice.

5. Method for adjusting the power of a gas-operated apparatus, said method comprising:

injecting a combustible gas mixture into a first chamber;

injecting a combustible gas mixture directly into a second chamber from a cartridge of the combustible gas mixture, said second chamber having a plurality of orifices, each of which is adapted to be closed and opened by a respective valve, for placing the second chamber in communication with the first chamber;

precompressing the combustible gas mixture in the first chamber when the first chamber is isolated from the second chamber and then generating a flame in the first chamber to combust the gas mixture;

allowing the flame to pass from the first chamber to the second chamber; and the power of the apparatus is adjusted by adjusting an amount of the gas mixture directly injected into the second chamber.

6. The method according to claim 5, in which the power of the apparatus is adjusted by adjusting the communication between the first and the second chambers.

7. The method as claimed in claim 5, wherein before allowing the flame to pass through the first chamber to the second chamber, passing the flame generated in the first chamber through an intermediate chamber for accelerating and further compressing the flame, said intermediate chamber connecting the orifices, provided at the second chamber, and the first chamber, thereby placing the first chamber in communication with the second chamber.

8. The method according to claim 7, in which the power of the apparatus is also adjusted by adjusting the communication between the chambers.

* * * * *